United States Patent [19]

Buchovecky et al.

[11] 4,069,042

[45] Jan. 17, 1978

[54] METHOD OF PRESSING AND FORGING METAL POWDER

[75] Inventors: Kalman E. Buchovecky, Oakmont; Milton R. Rearick, Lower Burrell, both of Pa.

[73] Assignee: Aluminum Company of America, Pittsburgh, Pa.

[21] Appl. No.: 638,948

[22] Filed: Dec. 8, 1975

[51] Int. Cl.[2] ..... B22F 3/00

[52] U.S. Cl. ..... 75/208 R; 75/224; 75/226

[58] Field of Search ..... 75/226, 224, 208 R, 75/206; 29/420.5

[56] References Cited

U.S. PATENT DOCUMENTS

| | | | |
|---|---|---|---|
| 3,631,583 | 1/1972 | Haller | 29/420.5 |
| 3,791,800 | 2/1974 | McGee | 75/206 |
| 3,866,303 | 2/1975 | Chehi | 29/420.5 |
| 3,899,821 | 8/1975 | Ito et al. | 29/420.5 |
| 6,834,003 | 9/1974 | Nayar | 75/208 R |

*Primary Examiner*—Benjamin R. Padgett
*Assistant Examiner*—Deborah L. Kyle
*Attorney, Agent, or Firm*—Carl R. Lippert; Patrick J. Viccaro

[57] ABSTRACT

A method is provided for pressing and forging hot metal powder directly in one operation into a high density metal article of a finished worked shape. The method uses a simple shaped, readily deformable container with loose metal powder therein and substantially closed to allow the powder to evolve its own protective atmosphere during preheat while permitting some gases to escape. The powder-filled container is pressed and forged in one operation in a preheated die cavity resulting in a high density article of a homogeneous composition. The invention is also well suited for cladding powder forged articles and producing composite articles from multiple powder alloys. The invention is particularly useful with powders of aluminum and its alloys.

12 Claims, No Drawings

METHOD OF PRESSING AND FORGING METAL POWDER

BACKGROUND OF THE INVENTION

This invention relates to an improved method of forming high density metal articles from metal powder. More particularly, the invention relates to a method for direct pressing and forging of articles from preheated loose metal powder contained in a substantially closed deformable metal container. The improvement is particularly suited to the forging of powders of aluminum and its alloys.

Methods of hot forging of high density metal articles from metal powder are known in the field of powder metallurgy. In general practice metal power flows into a die cavity where it may be pressed or compacted into an intermediate shape before it is forged into a shape of a final article. At the pressing stage to form an intermediate shape, heat may be added to aid interparticle bonding to form a compact of metal powder. Metal powder may also be cold compacted, i.e. pressed without the addition of heat, into an intermediate shape. These compacts are sintered and repressed into another intermediate shape, or are forged into the finished shape of the worked article.

It is further known in the art of fabricating powdered metal to place metal powder in a deformable container and to compact the powder in the container to the desired density and shape by techniques such as rolling, extruding and forging of the power-filled container. The powdered metal may be compacted into compacts which are stacked in a metallic container and the container and compacts evacuated, heated and deformed as in the forging method described in U.S. Pat. No. 3,899,821, granted Aug. 19, 1975. A metallic container filled with loose powder can be sealed, evacuated, heated and deformed in compacting the metal powder into an article of high density by applying a compressive force axially in a longitudinal portion of an extrusion chamber. U.S. Pat. No. 3,631,583, granted Jan. 4, 1972, describes such a method. Hot-rolling of an evacuated, sealed, heated container filled with metal powder is shown in U.S. Pat. No. 3,866,303, granted Feb. 18, 1975. Thus the prior art practices include cold compacting and sintering, cold compacting and hot repressing, or hot forging of powder in sealed containers. Such methods add to the complexity of forging operations in that effort and apparatus are needed to evacuate the air from the powder-filled container, to seal the container, to compact the powder to an intermediate shape and to reheat the powdered material. It is desirable, therefore, to provide a less complicated method of forging metal powder that eliminates the steps of compacting to an intermediate shape and sintering while providing a forged article having improved mechanical properties and metallurgical characteristics.

SUMMARY OF THE INVENTION

In accordance with the present invention, an improved method for forging metal parts from metal powder eliminates any need of degassing a closed metal container with metal powder therein, of compacting and repressing into an intermediate shape, and of removing a deformed metal container after forging. The invention, generally includes placing in a metal container of light gauge metal foil loose metal powder. The container, of the general simple shape related to the article to be forged, is substantially closed with a cover during heating to contain the powder and to shield the powder from contamination. The cover also permits the powder to generate its own protective atmosphere during preheating while permitting some gases to escape from the container. The amount of metal powder put into the container is in excess of the metal needed to forge the article to a predetermined density and is heated to a uniform temperature to facilitate metallurgical bonding. Forging of the powder-filled container into an article of at least 99% density is done within closed dies having limited relief for flash. Such an uncomplicated method provides a forged article having a homogeneous composition when the container and powder are of the same composition. Cladded forged articles from metal powder are obtained when the metal container and cover are of an alloy that is different from the metal powder but is compatible in that it bonds with the forged metal powder to form a composite product. Composite forged articles are also obtained by placing multiple powder alloys in the metal container. Thus the method facilitates forging metal powder without the need for complex multi-action tools or intricately shaped containers and provides for forged powder metallurgy parts having improved mechanical properties and/or metallurgical characteristics over conventionally forged powder metal parts.

DETAILED DESCRIPTION OF THE PREFERRED EMBODIMENTS OF THE INVENTION

The metal container employed by the invention is of a readily deformable simple shape generally in the configuration of, or related to, the detailed shape of an article to be forged. By simple shape is meant that the container has the outward appearance of the shape of the article to be forged, e.g. rectangular, triangular or cylindrical, without the detailed features and configurations of the shape of the forged article. Such a form of the container will be sufficient if it contains the metal powder in a manner as to assure filling of a forged article during pressing and forging. A readily deformable container is one that has sufficient strength to maintain its shape to contain the powder while placing and heating of the powder in the container and during any transferring of the powder filled container into a die cavity or elsewhere. Preferably, the metal container has an open-end for receiving metal powder and is made of a light gauge metal foil, such as aluminum and its alloys, of a gauge thickness generally between 0.0005 to 0.040 inch depending upon the structural requirements as determined by the weight and shape of the article to be forged. Conceivably the container thickness could be as thick as 0.125 inch for extremely large forgings.

The composition of the metal container may be the same as the metal powder or may differ. The invention thus provides a unique opportunity to produce clad products and parts composed of multiple powder alloys. The invention also provides an advantage in that the powder forged parts may have increased mechanical properties due to the plastic deformation and flow of both the metal powder and the metal container during the pressing and forging step. A finished forged product of a powder-filled container of the invention having the same composition as the powder, results in a homogeneous forged article of uniform alloy composition having improved mechanical properties over a forged article produced by conventional powder metallurgy techniques. A composite forged article is provided when the composition of the metal container differs from but is compatible with the composition of the metal powder. An alloy compatible with the metal powder is one that bonds with the metal powder during forging to provide a composite forged article, clad with an alloy of the metal container. If the metal container and cover are to be removed after forging by subsequent machining or by caustic etching, the metal container and cover need not be compatible and bond with the powder. Furthermore, powders of various compositions and characteristics can be selectively placed in the metal container to produce a forged article having unique and special properties in desired locations of the article. The finished forged shape of a forged article is the final worked shape of powder metal resulting from the pressing and forging operation and having over 99% density. The forged article may and most often does require machining before its end use. It may also include both additional forging or other working to change its shape without significantly affecting the density and some machining before its end use.

A cover is provided for substantially closing an open-end of the metal container. The cover must be in place during the heating of the powder-filled container to obtain maximum properties and is preferably of a light gauge metal foil of the same composition as the powder or metal container. The cover, however, can be of any composition and may be removed just prior to forging. One purpose of the cover is to keep the metal powder from blowing out of the container due to activity caused by any moisture on the powder particles and air between the particles during the preheat cycle. The cover also shields the powder from the furnace environment or any fan circulated furnace atmosphere during heating. Substantially closing the container confines the powder in its own evolved atmosphere protecting it against oxidation, but still provides ventilation of the container to permit some of the evolved gases to escape. Ventilation may be provided by loosely attaching the cover to the container so as to permit gases to escape or by providing holes in the cover or by other means. A purpose of maintaining a cover over the open-end of the container while in the die cavity and during forging is to protect the metal powder from contamination by absorption and adsorption of lubricants within a die cavity.

A die cavity for pressing and forging the metal powder is of the closed die type, preferably heated and lubricated. The lubricant is one selected to suit die and forging temperatures, to aid in the plastic flow and to provide release of the finished forged article. Commercially available and typical forging lubricants may be used. Operating temperature of the die must be compatible with the alloy being fabricated, the geometry of the article, and the forging rate achieved with the forging equipment being used. The design of the die cavity should limit the escape of loose powder or plastic flow of excess metal from the cavity until the forging pressure exceeds that required to fill the cavity and produce metallurgical bonding of the powder. The dies also preferably have provision for escape of the excess metal, commonly known as flash.

In the method of direct pressing and forging of hot loose metal powder, a simple metal container in the general shape of the article to be forged receives loose metal powder to about 50–60% density. The loosely filled powder is not necessarily or even usually distributed in proportion to the corresponding volume of an article to be forged, but may be unevenly placed in the container. The powder may also be lightly tamped or packed in the container. By this it is meant that the powder particles undergo no deformation and are thus still loose. During the pressing and forging, it has been found that the metal powder and container are compacted with a result that metal material is displaced from areas containing an excess to areas originally deficient in material. Plastic deformation and shearing as well as compressive forces are thus produced. It is preferable that the amount of powder used be in excess of the metal material necessary to forge a desired article to the predetermined density. Additional deformation is therefore achieved by using an excess of material and allowing it to escape from the die cavity once the powder is compacted and forced to fill the cavity. This also assures plastic deformation and produces shearing and compressive forces during the pressing and forging operation. The shearing deformations tend to promote interparticle bonding and healing or closing of interparticle voids which are not healed by normal compressive forces. As a result of plastic deformation achieved, mechanical properties and densities are improved in relation to the properties attained by the usual practice of compacting and sintering. Additionally, the typical mechanical properties of wrought materials, which generally are superior over powder metallurgy products, have been exceeded in at least one case using powdered aluminum alloy 6061 and the method herein described.

The metal container with the metal powder therein, maintains a cover of light gauge metal foil, preferably of the same composition as the metal container, loosely attached to the open-end of the container to substantially close the container during preheat. The cover is not sealed on the container and it is not necessary to evacuate the container of air before closing. The substantial closing of the container permits venting of the container to allow some evolved gases to escape while a sufficient portion of the gases are retained to have an atmosphere protective against oxidation. Alternately, it is within the scope of the invention to provide venting of the container by other means during heating.

The powder-filled metal container is placed in a preheating unit for a sufficient length of time to assure uniform temperature throughout the contained powder. The cover shields the powder from the environment of the preheat unit. The preheat time necessary is dependent upon several factors including the volume amount of powder to be heated. The temperature to which the powder-filled container is heated should be sufficiently high as to facilitate bonding of the particular alloy powder under plastic deformation during forging. Such temperatures should be below the melting point of the alloy and for aluminum and its alloys, the temperatures should be at least 600° F and may range from 600° F to 1050° F. The preheating can be done in air, vacuum, or in any other suitable atmosphere. Furthermore, the temperature and atmosphere must be selected to provide suitable properties for the particular powder composition being pressed and forged. The cover during preheat keeps the powder from blowing out of the container due to moisture on the powder particles or air between the particles. Furthermore, it permits the evolving hydrogen from the heating powder to be partially contained within the container to act as a protective atmosphere. In the preferred embodiment, after the heating operation, the preheated powder-filled container is transferred to a forging die for fabrication. It is within the scope of the invention that the powder may be heated in the die or otherwise to avoid the need to transfer the powder-filled container. Furthermore, the cover may be removed just prior to forging.

The pressing and forging operation is preferably performed as one step in a single action closed forging die. The powdered metal must be kept above a minimum temperature required to achieve bonding and metal flow at any selected forging pressure. The temperature is that temperature above which the bonding and plastic deformation of the metal powder is facilitated. Since bonding is dependent on both temperature and pressure, increases in temperature permit decreases in pressure, and decreases in temperature permit increases in pressure. For aluminum and its alloys, that temperature should be at least 600° F for typical commercially used forging pressures. In order for the metal powder and forged article to hold or exceed the minimum temperature requirement throughout the pressing and forging step, the dies can be operated at or above the minimum temperature. Preferably, the contained powder is also preheated to or above the minimum temperature.

The dies may be operated at a lower temperature provided that the contained powder is heated to a sufficiently high temperature that it will maintain a minimum required temperature despite heat loss to a colder die during forging. The magnitude of an adjustment in preheat temperature to compensate for heat losses to a colder die depends upon the die temperature, the mass and heat conductivity of the die and powder, the geometry and surface area of the article being forged, and the intimate contact time, i.e. dwell time, between the article and die as is governed by the speed of the pressing and forging operation.

unless the dies are operated at or above the minimum temperature required to achieve bonding and metal flow, the multiplicity of variables requires that optimum conditions be determined and tailored for each individual article and alloy. Preferably, and for economic reasons, the dies are preheated to or above the minimum temperature.

The preheated powder-filled container is pressed and forged into the desired shape having a predetermined density approaching 100% density without the need for an intermediate shape. Preferably, the forging is performed in one operation. The pressing and forging operation continues until all die cavities are filled, bonding of the powder particles occurs and usable engineering properties are achieved. The dwell time of the forging punch at a maximum sustained pressure may be as long as 10 seconds. The rate of forging is dependent upon the temperature, alloy and article to be pressed and forged. The forged article is ejected from the die and is ready for use after the removal of flash and after machining. The article may also again be forged to another shape before machining.

In order to more completely understand the invention, the following example is presented:

EXAMPLE

A pre-alloyed powder having 75–90% −325 mesh particles containing nominally 20% Si, 4.5% Mn, and the remainder essentially aluminum fills a simple shaped aluminum foil container. The composition of the container is of commercial purity aluminum base alloy. The container is nominally of 0.005 inch gauge and is generally triangular in shape with outside dimensions of about 8 inch × 8 inch × 8 inch × 2½ inch high. A light gauge foil of nominally 0.00075 inch gauge of the same composition as the container loosely covers the open-end of the container. It does not seal the container but substantially closes it to permit venting of some evolved gases during preheat. The powder-filled container is placed in a preheating unit and heated to a temperature of between 700°–1000° F, preferably 800° F, in a nitrogen atmosphere for 120 minutes. In accordance with the invention, the container is transferred to a lubricated die cavity which is heated to a temperature of between 700° –750° F. At a forging pressure of 45 tons per square inch, and at a speed of 10 inches per minute, with a sustained pressure dwell time of 10 seconds, the container is pressed and forged into the desired shape. The forged article produced in accordance with the invention has a tensile strength of 55,000–60,000 p.s.i. and yield strength of 40,000–45,000 p.s.i.

While the invention is described with particular reference to metal powders, metal containers, and metal covers of aluminum and its alloys, it is believed suited to use with other metals, particularly non-ferrous metals and especially light metals meaning aluminum or magnesium or their alloys.

Although a preferred embodiment and alternative embodiments have been described, it will be apparent to those skilled in the art that many changes can be made therein without departing from the scope of the invention.

What is claimed is:

1. A method for forging metal powders of aluminum and its alloys comprises:

placing in an open-ended readily deformable metal container an amount of loose powder, said container having a general shape of an article to be forged, and the amount of said powder being more than sufficient metal needed to forge the article to a predetermined density;

heating said powder within said container to a substantially uniform temperature below the melting point of the powder but at least 600° F to facilitate metallurgical bonding of said powder during conditions of plastic deformation;

maintaining over the open-end of said container during heating a cover sufficient to contain the powder and to allow for escape of gases evolved from heating the powder within said container but to retain in said container a sufficient portion of said gases to effectively shield the powder and provide an oxidation protective atmosphere; and forging said container with said powder therein into a forged shape of the article having a predetermined density of at least 99% by compressing within substantially closed dies and effecting plastic flow of the metal, the dies having provision for escape of excess metal.

2. A method as set forth in claim 1 wherein said container is composed of light gauge metal foil or formed sheet of sufficient strength to contain the powder and maintain its shape during the steps of placing and heating of the powder in said container.

3. A method as set forth in claim 2 wherein said metal foil container is of a gauge thickness of between 0.0005 inch to 0.040 inch.

4. A method as set forth in claim 2 wherein said container is composed of material having the same composition as said powdered metal to serve as an exterior surface of the forged article having a homogeneous composition.

5. A method as set forth in claim 2 wherein said container is composed of material which differs in composition from the metal powder and is compatible therewith to provide a cladding on the forged article.

6. A method as set forth in claim 1 wherein more than one metal powder is placed in selected locations in said metal container, each metal powder having different compositions and characteristics to provide a composite forged article having different mechanical properties and metallurgical characteristics at the locations.

7. A method as set forth in claim 1 wherein said loose powdered metal is packed in said container without deforming said metal powder.

8. A method as set forth in claim 1 wherein said die is preheated to a temperature that is higher than said temperature sufficient to facilitate bonding of the metal powder during plastic deformation.

9. A method as set forth in claim 1 wherein said cover is composed of material having the same composition as said container.

10. A method as set forth in claim 1 wherein forging of said container with said powder therein is performed in one compressive step.

11. A method as set forth in claim 1 wherein the container is aluminum or an alloy thereof.

12. A method for forging metal powders of aluminum and its alloys comprises:

placing in an open-ended readily deformable metal foil container an amount of loose powder, said container having a general shape of an article to be forged, and the amount of said powder being an excess of metal needed to forge the article to a predetermined density;

substantially closing the open-end of said container with a cover of the same composition as said container to contain the powder and to allow for venting of a portion of gases evolved from heating the powder within said container while shielding the powder and providing an oxidation protective atmosphere in said container by retaining a portion of said gases;

heating said powder within said container to a substantially uniform temperature below the melting point of the powder but at least 600° F to facilitate metallurgical bonding of said powder during plastic deformation; and forging said container with said powder therein in one compressive step to effect plastic flow of the metal into a forged shape of the article having a predetermined density of at least 99% within substantially closed dies having relief for escape of excess metal.

* * * * *